United States Patent [19]

Schmalz

[11] 4,018,169

[45] Apr. 19, 1977

[54] METHOD AND APPARATUS FOR PROCESSING METAL MATERIAL INTO BALES

[75] Inventor: Roman Schmalz, Milwaukee, Wis.

[73] Assignee: Logemann Brothers Company, Milwaukee, Wis.

[22] Filed: Feb. 9, 1976

[21] Appl. No.: 656,708

[52] U.S. Cl. ..... 100/39; 100/DIG. 1; 100/42; 100/98 R; 100/215; 100/218; 100/232; 100/233

[51] Int. Cl.[2] ..... B30B 9/32

[58] Field of Search ..... 100/39, 42, 98 R, 215, 100/218, 232, 233, DIG. 1

[56] References Cited

UNITED STATES PATENTS

| | | | |
|---|---|---|---|
| 1,812,797 | 6/1931 | Lindemann | 100/98 R |
| 2,605,657 | 8/1952 | Lindemann et al. | 100/98 R |
| 2,865,284 | 12/1958 | Thompson et al. | 100/218 |
| 2,907,530 | 10/1959 | Pyles | 100/DIG. 1 |
| 2,960,927 | 11/1960 | Aichelen | 100/218 |
| 2,984,174 | 5/1961 | Jones | 100/DIG. 1 |
| 3,101,045 | 8/1963 | Van Endert | 100/DIG. 1 |
| 3,367,019 | 2/1968 | Williamson | 100/DIG. 1 |
| 3,545,369 | 12/1970 | Tokushima | 100/98 R |
| 3,606,809 | 9/1971 | Chazen | 100/DIG. 1 |

FOREIGN PATENTS OR APPLICATIONS

| | | | |
|---|---|---|---|
| 845,438 | 11/1952 | Germany | 100/DIG. 1 |
| 671,596 | 5/1952 | United Kingdom | 100/98 R |

OTHER PUBLICATIONS

"Ironage", vol. 170, Issue 8, p. 8, Aug. 21, 1952.

*Primary Examiner*—Billy J. Wilhite
*Attorney, Agent, or Firm*—Michael, Best & Friedrich

[57] ABSTRACT

A frame having a baling chamber formed therein and a feed hopper member pivotally mounted adjacent the chamber for introducing a car body or similar article partially into the baling chamber. A cover member is pivotally mounted adjacent the other side of the baling chamber and has a front edge constructed as a cutting edge. The cover member when pivoted to its open position permits the introduction of the car body into the baling chamber by tilting the feed hopper member. The cover member, when pivoted to its closed position after the car body is partially introduced into the baling chamber, will partially crush and bend the car at approximately the middle portion thereof so that substantially one-half of the car body will be inside the baling chamber and the other half will protrude out of the baling chamber through the space adjacent the front edge of the cover member. The portion of the car body protruding out of the baling chamber is sheared off and a portion of the car body remaining in the chamber is then partially crushed by moving the head of a first compression ram into the baling chamber. The ram head has a cutting edge thereon which cooperates with the cutting edge on the cover member to produce the desired shearing action therebetween. The partially compressed material in the baling chamber is then further compressed into a completed bale by moving the head of a second compression ram into the baling chamber underneath the cover. The travel path of the second compression head is at right angles to the travel path of the first compression head. The completed bale is removed from the baling chamber by actuating a gate member to expose an opening in the bottom of the baling chamber to thereby permit the completed bale to drop out of the chamber through the opening by gravity.

11 Claims, 12 Drawing Figures

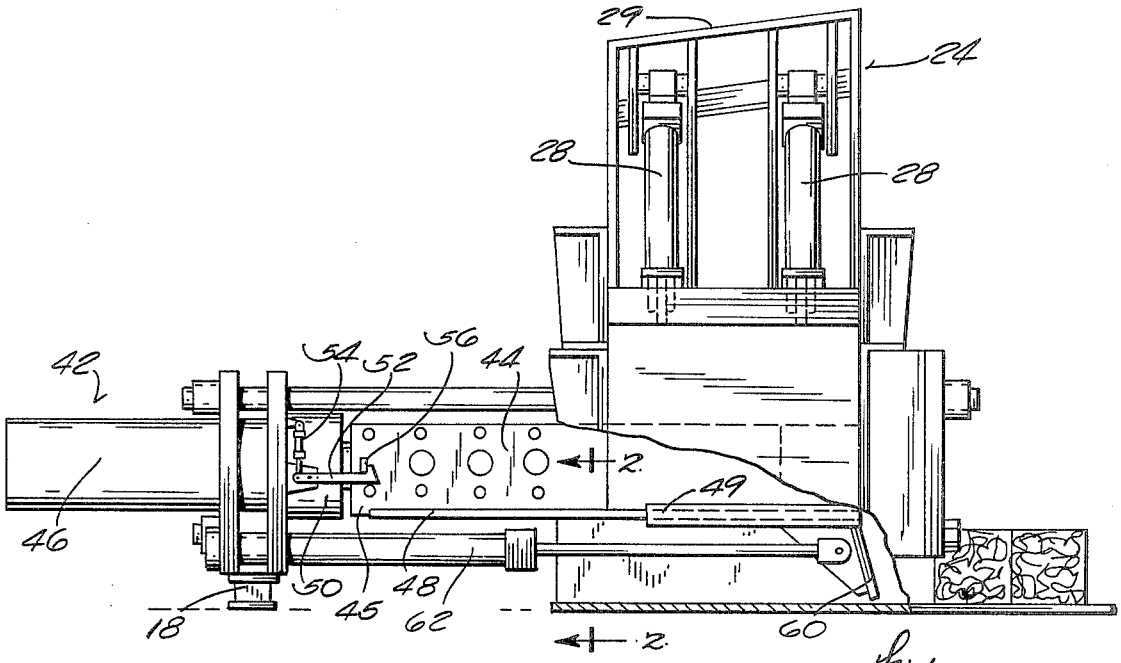
Fig. 1
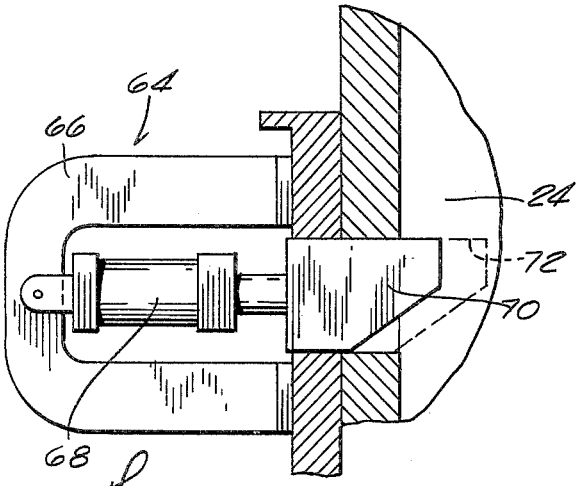
Fig. 5
Fig. 2
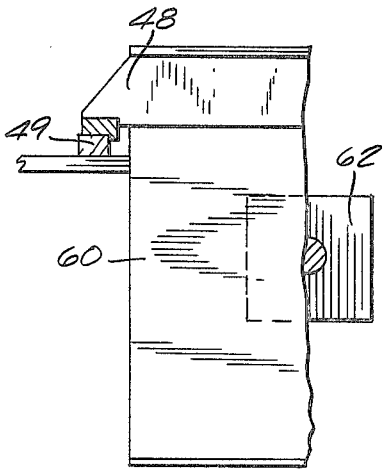

22
20
29
24
42
48
64
64
5
5
4
4

22
40
26
34
12
36
30
14
38
35
32
16
29
24
44
48
28
10

METHOD AND APPARATUS FOR PROCESSING METAL MATERIAL INTO BALES

BACKGROUND OF THE INVENTION

I. Field of the Invention.

This invention relates to a method and apparatus for processing metal material into bales and more specifically it relates to a method and apparatus for processing a car body into two bales of approximately equal size.

II. Description of the Prior Art.

Prior apparatus for processing car bodies into bales were usually designed to process the entire car body into a single bale. Such apparatus produced bales of relatively large size and if a relatively small size was desired, the apparatus would require extremely high compression forces to produce the bale. The method and apparatus of the present invention is designed to produce two bales from a single car body resulting in a relatively small bale size having its maximum dimension of 40 inches or less as required for charging a conventional electric furnace. This double bale approach is accomplished with reasonable compression forces, relatively rapid speed and with a minimum of operator attention to operate the apparatus.

SUMMARY OF THE INVENTION

Baling apparatus comprising a frame having a baling chamber formed therein and a feed hopper means for introducing material to be baled into the chamber. A cover member is pivotally mounted adjacent one side of the baling chamber and has a front edge constructed as a cutting edge. The cover member when closed extends over at least one-half of the baling chamber. A first compression ram is mounted adjacent the baling chamber and includes a compression head movable into the chamber underneath the cover member. The compression head has a front edge constructed as a cutting edge for cooperation with the cover cutting edge to shear off the material in the chamber from any material protruding outside the chamber. The first compression head further operates to partially compress the material in the chamber. A second compression ram including a second compression head is mounted adjacent the baling chamber. The head is movable into the chamber underneath the cover in a direction at right angles to the movement of the first compression head. Said second compression head is adapted to compress the material in the chamber into a completed bale.

DESCRIPTION OF THE DRAWINGS

FIG. 1 is an end elevation view of the baler apparatus of the present invention;

FIG. 2 is an enlarged fragmentary sectional view taken along line 2—2 of FIG. 1;

FIG. 5 is an enlarged fragmentary sectional view taken along line 5—5 of FIG. 3;

DESCRIPTION OF THE PREFERRED EMBODIMENT

Figure 3:
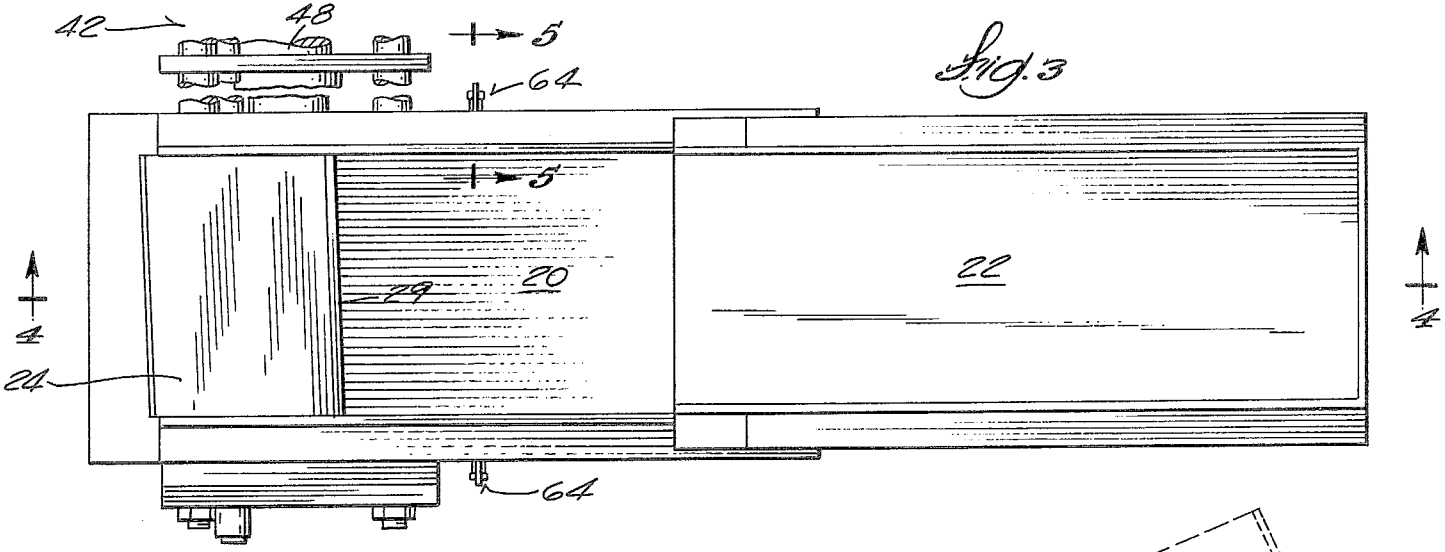
FIG. 3 is a top plan view of the baler apparatus shown in FIG. 1.

Referring to the drawings in detail (FIGS. 1 and 4) the baler apparatus of this invention is comprised of a fabricated steel frame structure indicated generally by reference numeral 10. The frame 10 includes suitable support members 12, 14, 16 and 18.

Figure 4:
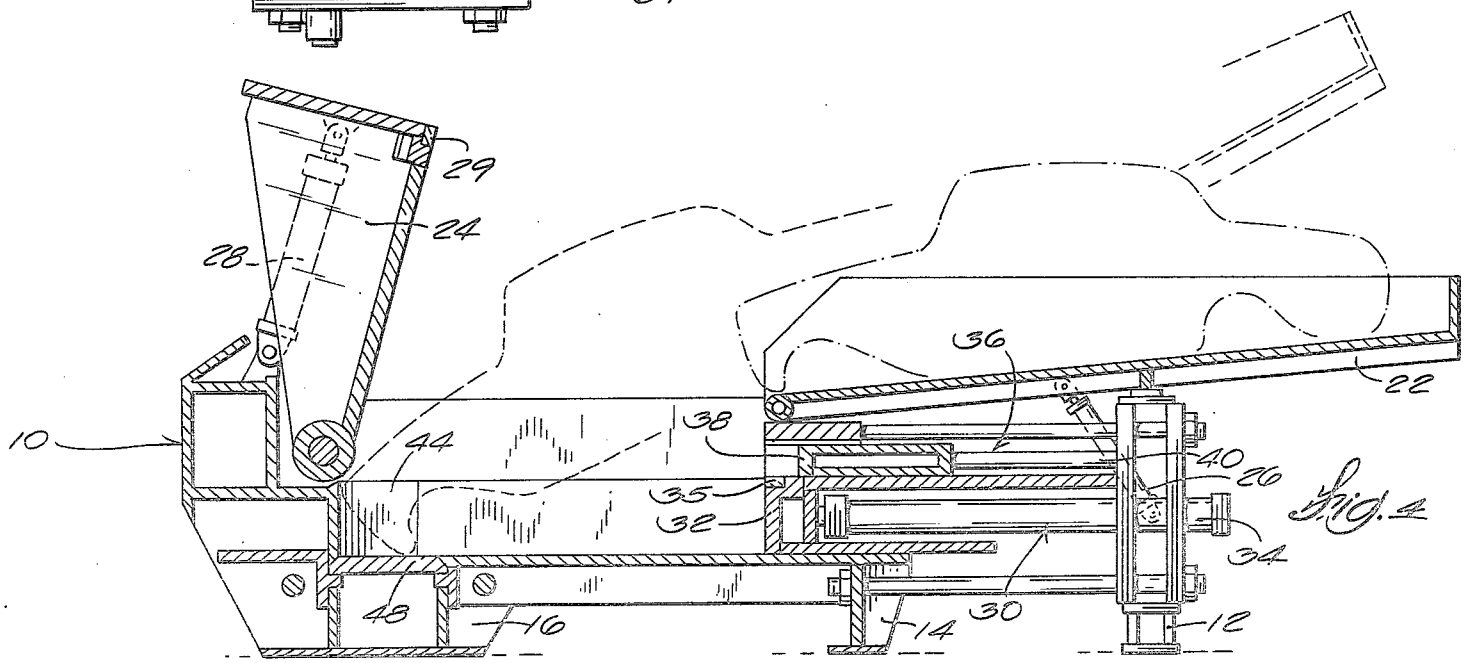
FIG. 4 is a sectional view taken along line 4—4 of FIG. 3.

Referring specifically to FIG. 4, frame 10 has a baling chamber 20 built into it with a feed hopper 22 pivotally mounted adjacent one side thereof and a cover member 24 pivotally mounted adjacent the other side thereof. As will be explained in more detail hereinafter baling chamber 20 has a first portion thereof in which a first stage compression occurs and a second portion thereof in which a second stage compression occurs. Hopper 22 is actuated by a power cylinder 26 and cover member 24 is actuated by a pair of power cylinders 28, 28. A shear knife 29 is mounted on the lower free edge of the cover 24. As shown in FIG. 1, such edge and shear plate is positioned at an angle with respect to the pivotal axis of the cover member itself.

Mounted adjacent the lower portion of chamber 12 is a first stage compression ram 30 including a baling head 32 driven by a double acting hydraulic power cylinder 34. A shear knife 35 is mounted along the upper edge of baling head 32. Travel of ram 30 is at right angles to the pivotal axes of cover 24 and hopper 22.

Mounted directly above ram 30 is a holding or clamping ram 36 including a clamping head 38 driven by a double acting hydraulic power cylinder 40.

As best shown in FIGS. 1, 3, 11 and 12, a second stage compression ram 42 is mounted adjacent the opposite side of chamber 20 from ram 30 for movement in a direction at right angles to the movement of ram 30. Ram 42 includes a baling head 44 driven by a single acting hydraulic power cylinder 46. Ram 42 also includes a latching mechanism 50 for holding the ram in its retracted position for reasons to be explained hereinafter. Latching mechanism 50 is comprised of a latch arm 52 pivotally mounted on the ram support frame, a power cylinder 54 for actuating the arm 52 and a latching lug 56 mounted on the ram head 44.

Mounted beneath ram 42 is an ejector ram 58 which includes an ejector head 60 pivotally mounted on the end of the piston rod of a double acting hydraulic power cylinder 62. Head 60 is positioned at an angle with respect to the vertical and is fastened at its upper end to a gate member 48. Gate member 48 is slidably mounted in the baler frame on track supports 49, 49. Head 44 of ram 42 is provided with a depending shoulder 45 adapted for engagement by gate 48 when the gate is moved in its opening direction.

As best shown in FIGS. 3 and 5, a pair of locking mechanisms 64 for cover 24 are mounted on opposite sides of baling chamber 20. Each mechanism 64 is comprised of a U-shaped support member 66, a power cylinder 68 pivotally mounted at one end to member 66 and fastened at the other end to a locking pin member 70. As will be explained in more detail hereinafter, pin 70 is actuated into and out of locking engagement with a recess 72 in cover 24.

OPERATION

Figure 6:
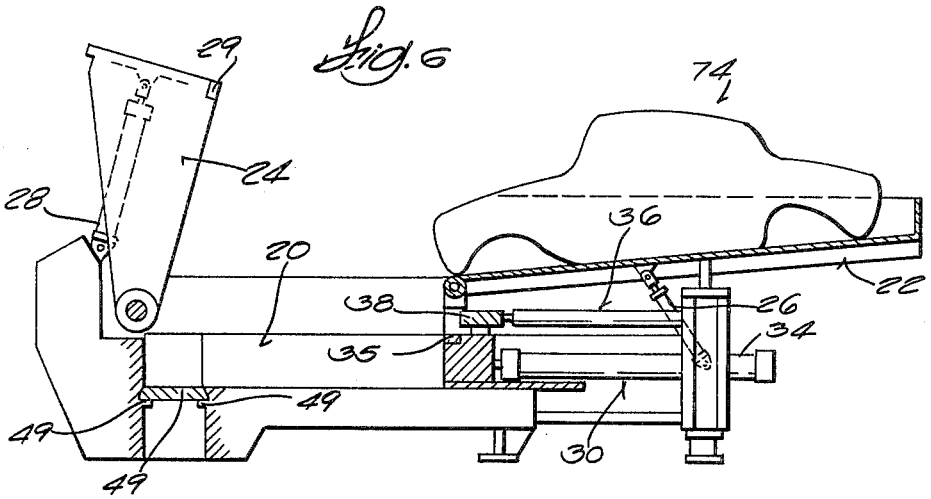
FIGS. 6, 7, 8, 9 and 10 are a series of partially schematic side elevation views (with parts broken away) showing the sequence of operation of the baler apparatus.

The first step is to position material to be baled (which in the preferred embodiment is a car body 74 with engine removed) on the top surface of feed hopper 22 while the hopper is in its retracted position (FIG. 6). This can be accomplished by any suitable means such as an overhead crane (not shown).

Figure 7:
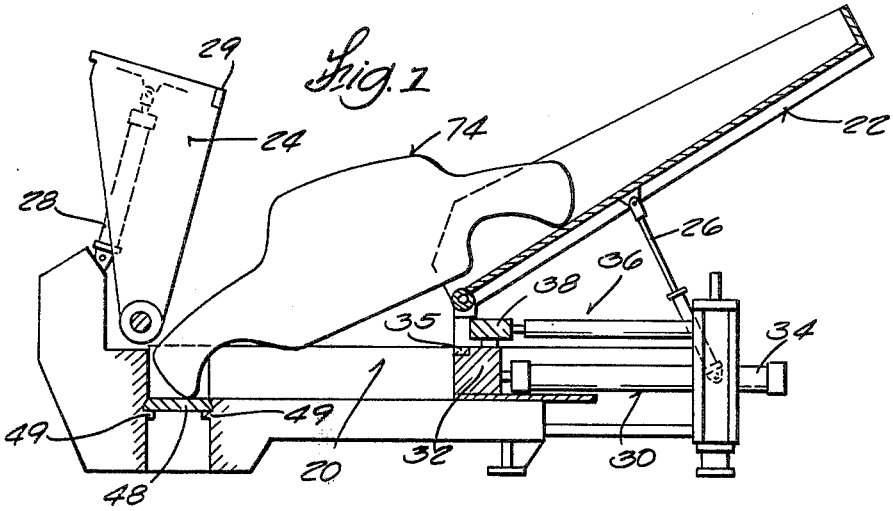

The next step is to energize power cylinder 26 to thereby tilt hopper 22 from the position shown in FIG. 6 to the position shown in FIG. 7. This in turn will cause car 74 to slide from its position on hopper 22 (FIG. 6) to a position wherein the front portion of the car is positioned in baling chamber 20 as shown in FIG. 7.

Figure 8:
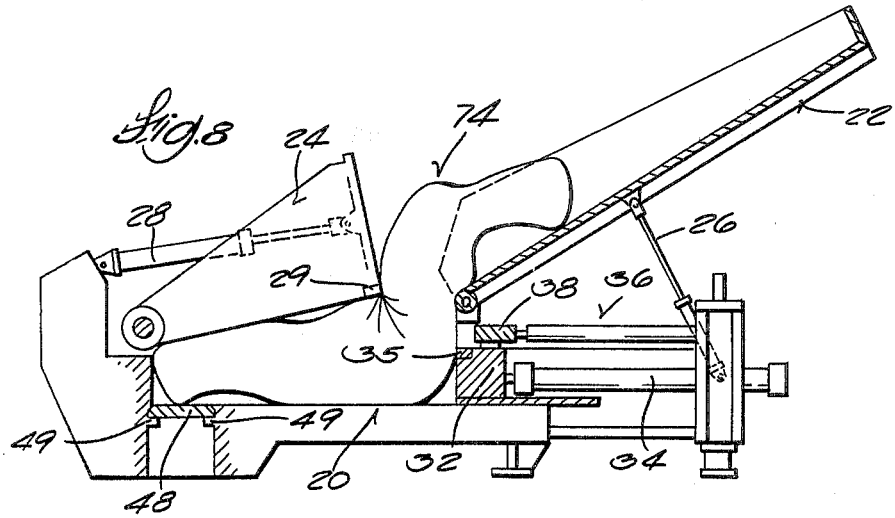
Figure 9:
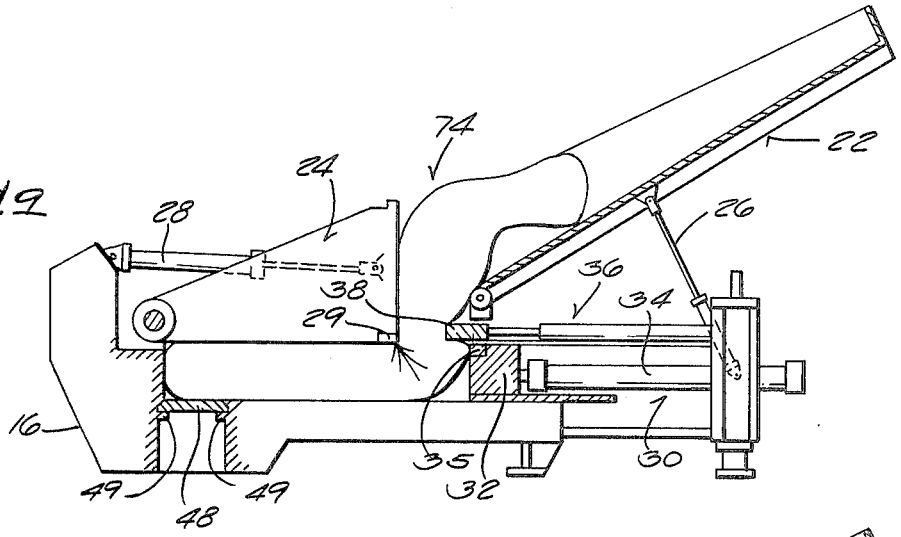

The next step is to energize power cylinders 28 of cover 24 to thereby pivot cover 24 in the closing direction from its fully opened position as shown in FIG. 7 to its partially closed position as shown in FIG. 8 and then to its completely closed position as shown in FIG. 9. After the cover is completely closed, power cylinders 68 of locking mechanism 64 are energized to thereby move locking pins 70 into locking recesses 72 to thereby securely lock the cover in its closed position. This movement of cover 24 will partially crush and bend or kink car 74 at approximately the middle thereof as best shown in FIG. 9, to thereby bend the car into a substantially L-shape. It should be noted at this point that cover 24 is made of a sufficient size so that when closed as shown in FIG. 9, it will extend over and cover approximately three-fourths of the baling chamber 20 leaving only a relatively small opening at the end of the chamber through which the rear portion of the car body protrudes.

The next step is to energize holding or clamping ram 36 to thereby move the head 38 thereof from its retracted position as shown in FIG. 8 to its clamping position as shown in FIG. 9. In such clamping position head 38 will be forced against the car to thereby hold it securely in chamber 20 during the subsequent shearing and baling step which will now be described.

Figure 10:
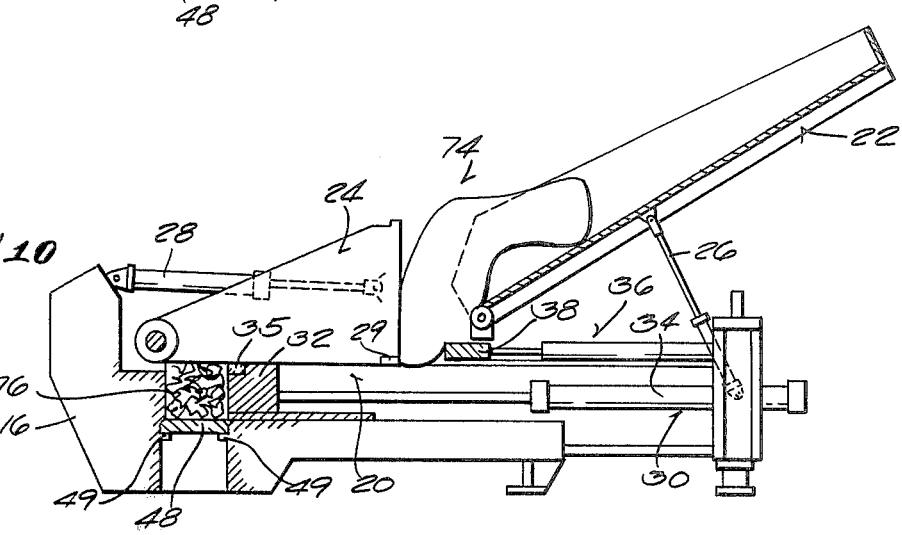

The combination shearing and baling step is performed by energization of first stage compression ram 30 from its retracted position as shown in FIG. 9 to its fully extended position as shown in FIG. 10. As the head 32 of ram 30 is driven forward by cylinder 34, the portion of the car in chamber 20 will be simultaneously compressed and sheared. The shearing action is produced by the relative movement of shear knives 35 and 29 mounted on the baling head 32 and cover 24 respectively. Thus during the initial movement of head 32 the material of the car body adjacent the head 32 will be compressed and then when knife 35 moves into shearing relationship with knife 29, the material in the chamber will be sheared to thereby cut the car in two substantially equal size pieces. The angled relationship of knife 29 with respect to knife 35 facilitates this shearing action. It should be noted that the shearing action exerted on the car body occurs during the initial movement of ram 30 and that most of the compressing action exerted on the car by ram 30 occurs thereafter.

Continued movement of baling head 32 to the fully extended position of the first stage compression ram 30 as shown in FIG. 10 will cause the material in chamber 20 to be compressed into a partially formed bale 76. Ram 30 is locked hydraulically in its fully extended position.

Figure 11:
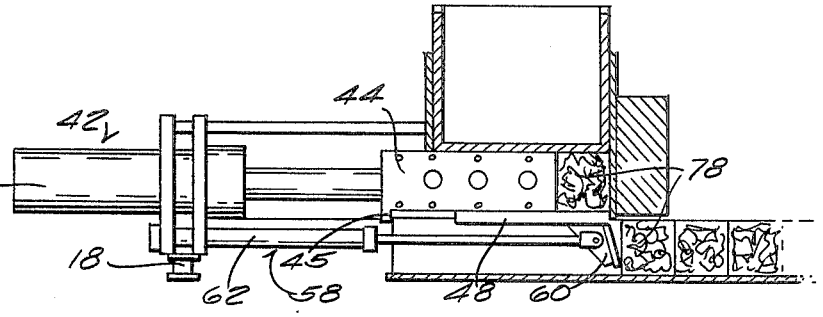
FIGS. 11 and 12 are two fragmentary end elevation views (with parts broken away) showing the final steps in the operation of the baler apparatus.

The next step is to complete the formation of a finished table. This is accomplished by energizing second stage compression ram 42 from its retracted position as shown in FIG. 1 to its fully extended position as shown in FIG. 11. Latching mechanism 50 must of course be opened before ram 42 is energized as described above. During this movement the ram head 44 will compress the already partially compressed material in the baling chamber into a completed bale 78. The rams 30, 36 and 42 are then decompressed and cover locks 64 are retracted to unlock position.

Figure 12:
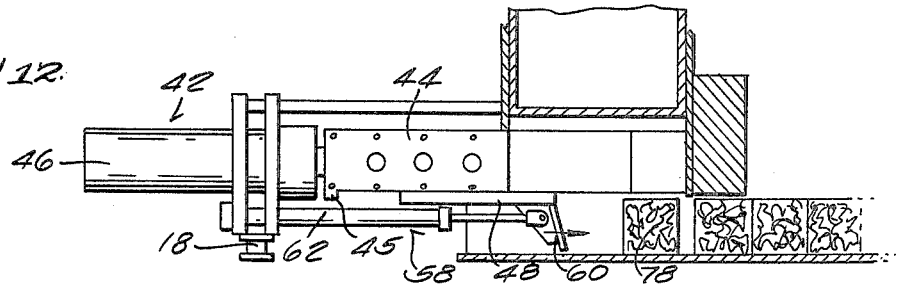

With the baling apparatus in the FIG. 11 position, the next step is to energize ejector ram 58 for movement in its retract direction. When this occurs, the ejector head 60 which is fastened to gate 48 will cause the gate to slide from its closed position as shown in FIG. 11 to its open position. The opening of gate 48 will allow the completed bale 78 to drop out of the baling chamber by gravity. The retract movement of ejector ram 58 will also cause gate 48 to engage shoulder 45 on head 44 of ram 42 to thereby slide the second stage compression ram 42 back to its retracted position as shown in FIG. 12. Thus since ram 42 is driven in its retract direction by ram 58, the compression ram 42 need only be of a single acting type to thereby reduce its cost.

After gate 48 is opened and ram 42 is returned to its fully retracted position by the energization of ram 58 in its retract direction, power cylinder 54 of latching mechanism 50 is energized, causing arm 52 to pivot into engagement with lug 56 to thereby lock ram 42 in its retracted position.

The next step is to again energize the ram 58 this time in the gate closing direction as shown in FIG. 12. Such movement of ram 58 will cause gate 48 to move into its closed position.

At the same time the angled head 60 on the ram will engage the bale 78 which has previously dropped from the baling chamber to thereby slide the finished bale out from under the baling chamber opening to the side of the baling apparatus. The fact that the head 60 is tilted somewhat from the vertical insures that the bale 78 is pushed completely out of the space between the opening in the baling chamber covered by gate 48.

It is noted that any tendency of the closing movement of the gate to also move head 44 of ram 42 due to the friction therebetween will be prevented by latching mechanism 50 and thus when the gate is closed by the energization of ram 58, ram 42 will remain in its fully retracted position.

This completes the formation of a completed bale from the front portion of the car 76. After this operation is complete cylinders 28, 40 and 34 are energized to open cover 24 and retract clamping head 38 and baling head 32.

Cylinder 26 is then energized to tilt hopper 22 from its retracted position to its tilted position, thus causing the remaining half of car body 74 to slide from the hopper into the baling chamber 20. After this is done the cover 24 is then closed and the baling operation as previously described is repeated to thereby form a second completed bale from the second half of the car body.

While the baling apparatus of the present invention can be of various sizes in one commercial model thereof, the baling apparatus has an overall maximum length of approximately 36 feet and overall height of approximately 17 feet and an overall width of approximately 24 feet. A unit of this approximate size will produce a bale measuring 24 inches by 24 inches by a variable of 40 inches or less having a weight of approximately 1500 pounds.

I claim:

1. Baling apparatus comprising:

a frame having a baling chamber formed therein;

a feed hopper means for introducing material to be baled into said baling chamber;

a cover member pivotally mounted adjacent one side of said baling chamber and having a front edge constructed as a cutting edge, said cover member adapted when closed to cover and extend over at least one-half of said baling chamber;

a first compression ram mounted adjacent said baling chamber, said first compression ram including a compression head movable into said chamber underneath said cover member, said compression head having a front edge constructed as a cutting edge for cooperation with said cover cutting edge to shear off the material in the chamber from any material protruding outside the chamber through the space adjacent the front edge of said cover, said shearing action occurring as said first compression ram is moved in its compression direction into said baling chamber;

a clamping ram mounted above said first compression ram for movement towards and away from the front edge of said cover member, said clamping ram adapted when energized in its clamping direction to engage and clamp the material protruding from said baling chamber when said cover is in its closed position; and a second compression ram mounted adjacent said baling chamber and movable into said chamber underneath said cover member in a direction at right angles to the movement of said first compression ram, said second compression ram adapted to compress the material in the chamber after said first compression ram is energized in its compression direction to thereby form a completed bale in the chamber.

2. Baling apparatus according to claim 1 in which said cover member has a locking mechanism therefor adapted to lock the cover member in its closed position.

3. Baling apparatus according to claim 1 in which said feed hopper means includes a feed hopper member pivotally mounted adjacent said baling chamber for movement between a substantially horizontal position to a tilted position, said feed hopper member adapted when pivoted from its horizontal to its tilted position to cause the material therein to slide from the hopper into said baling chamber.

4. Baling apparatus according to claim 1 in which said front cutting edge of said cover member is at an angle with respect to the cutting edge on said compression head of said first compression ram.

5. Baling apparatus according to claim 1 in which there is a gate member slidably mounted adjacent an opening in the bottom of said baling chamber, said gate member adapted when moved to its open position to allow the baled material in said chamber to drop therefrom by gravity.

6. Baling apparatus according to claim 5 in which there is an ejector ram mounted beneath said baling chamber and operatively connected to said gate member to thereby move said gate member between its open and closed positions, said ejector ram having an ejector head adapted to engage a bale after it has dropped out of said baling chamber and to thereafter slide the bale out from under the opening in said baling chamber.

7. Baling apparatus comprising:

a frame having a baling chamber formed therein;

a feed hopper means for introducing material to be baled into said baling chamber;

a cover member pivotally mounted adjacent one side of said baling chamber and having a front edge constructed as a cutting edge, said cover member adapted when closed to cover and extend over at least one-half of said baling chamber;

a first compression ram mounted adjacent said baling chamber, said first compression ram including a compression head movable into said chamber underneath said cover member, said compression head having a front edge constructed as a cutting edge for cooperation with said cover cutting edge to shear off the material in the chamber from any material protruding outside the chamber through the space adjacent the front edge of said cover, said shearing action occurring as said first compression ram is moved in its compression direction into said baling chamber;

a second compression ram mounted adjacent said baling chamber and movable into said chamber underneath said cover member in a direction at right angles to the movement of said first compression ram, said second compression ram adapted to compress the material in the chamber after said first compression ram is energized in its compression direction to thereby form a completed bale in the chamber;

a gate member slidably mounted adjacent an opening in the bottom of said baling chamber, said gate member adapted when moved to its open position to allow the baled material in said chamber to drop therefrom by gravity; and an injector ram mounted beneath said baling chamber and operatively connected to said gate member to thereby move said gate member between its open and closed positions, said ejector ram having an ejector head adapted to engage a bale after it has dropped out of said baling chamber and to thereby slide the bale out from under the opening in said baling chamber, said second compression ram being of a single acting type, and said gate member and said second compression ram adapted for engagement with each other when said gate member is moved by said ejector ram in the gate opening direction to thereby cause said second compression ram to move from its extended compression position to its retracted position.

8. Baling apparatus according to claim 7 in which there is a latching mechanism for said second compression ram, said latching mechanism adapted to hold said second stage compression ram in its retracted position when said ejector ram is energized in the gate closing direction.

9. A method of processing a car body or similar article into bales comprising the following steps:

a. introducing a car body partially into an upwardly opening baling chamber with a portion of the car body positioned inside the chamber and a portion of the car body positioned outside the chamber;

b. partially crushing and bending the car body by forcing a cover member partially over the open top of the baling chamber to thereby bend the car body into a substantially L-shape with one leg of the L positioned inside the baling chamber and the other leg of the L protruding out of the baling chamber adjacent the free end of the cover member;

c. shearing off the portion of the car body protruding out of the baling chamber and partially crushing the portion of the car body in the baling chamber by moving the head of a first compression ram into the baling chamber, said ram head and cover member having cutting edges thereon which cooperate to produce a shearing action therebetween; and d. compressing the material in the baling chamber into a completed bale by moving the head of a second compression ram into the baling chamber underneath the cover, the travel path of said second compression head being at right angles to the travel path of said first compression head.

10. The method of claim 9 in which the following step is performed after step (d):

e. removing the completed bale from the baling chamber by actuating a gate member to expose an opening in the bottom of the baling chamber to thereby permit the completed bale to drop out of the chamber through the opening by gravity.

11. The method of claim 10 in which the following steps are performed after step (e):

f. moving the gate member back to its closed position, retracting said first and second compression rams and opening the cover member to allow the remaining portion of the car body to be introduced into the baling chamber;

g. moving the cover member to its closed position;

h. actuating the first compression ram as in step (c);

i. actuating the second compression ram as in step (d); and j. actuating the gate member as in step (e).

* * * * *

UNITED STATES PATENT OFFICE

CERTIFICATE OF CORRECTION

Patent No. 4,018,169 Dated April 19, 1977

Inventor(s) Roman Schmalz

It is certified that error appears in the above-identified patent and that said Letters Patent are hereby corrected as shown below:

Column 3, line 68, delete "table" and insert -- bale --.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*